US008394563B2

(12) United States Patent
Shim et al.

(10) Patent No.: US 8,394,563 B2
(45) Date of Patent: Mar. 12, 2013

(54) CARBON BLACKS, TONERS, AND COMPOSITES AND METHODS OF MAKING SAME

(75) Inventors: Anne K. Shim, Plaistow, NH (US); Eugene N. Step, Newton, MA (US); Agathagelos Kyrlidis, Malden, MA (US)

(73) Assignee: Cabot Corporation, Boston, MA (US)

( * ) Notice: Subject to any disclaimer, the term of this patent is extended or adjusted under 35 U.S.C. 154(b) by 1074 days.

(21) Appl. No.: 12/157,100

(22) Filed: Jun. 6, 2008

(65) Prior Publication Data

US 2008/0305422 A1 Dec. 11, 2008

Related U.S. Application Data

(60) Provisional application No. 60/942,948, filed on Jun. 8, 2007.

(51) Int. Cl.
*G03G 9/08* (2006.01)

(52) U.S. Cl. ..... 430/108.11; 430/108.9; 430/110.3; 430/110.4

(58) Field of Classification Search ..... 430/108.11, 430/108.9, 110.3, 110.4
See application file for complete search history.

(56) References Cited

U.S. PATENT DOCUMENTS

| | | | |
|---|---|---|---|
| 4,014,844 | A | 3/1977 | Vidal et al. |
| 4,601,968 | A | 7/1986 | Hyosu |
| 4,845,007 | A | 7/1989 | Hyosu et al. |
| 4,994,520 | A | 2/1991 | Mori et al. |
| 5,043,404 | A | 8/1991 | Mahabadi et al. |
| 5,275,900 | A | 1/1994 | Ong et al. |
| 5,278,018 | A | 1/1994 | Young et al. |
| 5,484,575 | A | 1/1996 | Steenackers |
| 5,510,221 | A | 4/1996 | Matalevich et al. |
| 5,545,504 | A | 8/1996 | Keoshkerian et al. |
| 5,571,311 | A | 11/1996 | Belmont |
| 5,571,654 | A | 11/1996 | Ong |
| 5,589,531 | A | 12/1996 | Menashi et al. |
| 5,630,868 | A | 5/1997 | Belmont et al. |
| 5,725,650 | A | 3/1998 | Flenniken et al. |
| 5,741,618 | A | 4/1998 | Shigemori et al. |
| 5,747,559 | A | 5/1998 | Whitehouse et al. |
| 5,747,563 | A | 5/1998 | Flenniken et al. |
| 5,851,280 | A | 12/1998 | Belmont et al. |
| 5,919,841 | A | 7/1999 | Mahmud et al. |
| 5,948,835 | A | 9/1999 | Mahmud et al. |
| 5,955,232 | A | 9/1999 | Little et al. |
| 5,968,702 | A | 10/1999 | Ezenyilimba et al. |
| 5,977,210 | A | 11/1999 | Patel et al. |
| 5,977,213 | A | 11/1999 | Mahmud et al. |
| 6,008,272 | A | 12/1999 | Mahmud et al. |
| 6,017,980 | A | 1/2000 | Wang et al. |
| 6,028,137 | A | 2/2000 | Mahmud et al. |
| 6,054,238 | A | 4/2000 | Little et al. |
| 6,057,387 | A | 5/2000 | Mahmud et al. |

(Continued)

FOREIGN PATENT DOCUMENTS

| | | | |
|---|---|---|---|
| EP | 0 272 127 | A2 | 6/1988 |
| EP | 0 749 991 | A2 | 12/1996 |

(Continued)

OTHER PUBLICATIONS

JP57116348 to Ricoh KK (Jul. 20, 1982)—Abstract Only.

(Continued)

*Primary Examiner* — Jonathan Jelsma

(57) ABSTRACT

A chemical toner is described as well as methods of preparing the same.

14 Claims, 5 Drawing Sheets

Optical image of Modified Carbon black 1
(phenyl-modified R660) in styrene acrylate toner polymer

U.S. PATENT DOCUMENTS 6,068,688 A 5/2000 Whitehouse et al.
6,090,439 A 7/2000 Menon et al.
6,103,380 A 8/2000 Devonport
6,140,394 A 10/2000 Kamiyama et al.
6,159,540 A 12/2000 Menon et al.
6,172,154 B1 1/2001 Brown et al.
6,174,926 B1 1/2001 Menon et al.
6,191,194 B1 2/2001 Anand et al.
6,211,279 B1 4/2001 Mahmud et al.
6,218,067 B1 4/2001 Belmont
6,221,143 B1 4/2001 Palumbo
6,264,357 B1 7/2001 Kamiyama et al.
6,323,273 B1 11/2001 Mahmud et al.
6,336,965 B1 1/2002 Johnson et al.
6,337,358 B1 1/2002 Whitehouse et al.
6,350,519 B1 2/2002 Devonport
6,364,944 B1 4/2002 Mahmud et al.
6,368,239 B1 4/2002 Devonport et al.
6,372,820 B1 4/2002 Devonport
6,432,194 B2 8/2002 Johnson et al.
6,440,628 B1 8/2002 Watanabe et al.
6,472,471 B2 10/2002 Cooke et al.
6,478,863 B2 11/2002 Johnson et al.
6,494,943 B1 12/2002 Yu et al.
6,503,680 B1 1/2003 Chen et al.
6,506,245 B1 1/2003 Kinney et al.
6,534,569 B2 3/2003 Mahmud et al.
6,551,393 B2 4/2003 Devonport et al.
6,562,541 B2 5/2003 Vanbesien et al.
6,664,312 B2 12/2003 Devonport
6,787,280 B2 9/2004 Yamashita et al.
6,852,158 B2 2/2005 Belmont et al.
6,911,073 B2 6/2005 Adams et al.
6,929,889 B2 8/2005 Belmont
6,936,097 B2 8/2005 Shakhnovich
6,942,724 B2 9/2005 Yu
6,953,825 B1 10/2005 Whitehouse et al.
6,964,992 B2 11/2005 Morris et al.
7,056,962 B2 6/2006 Johnson et al.
7,173,078 B2 2/2007 Lamprey et al.
7,205,357 B2 4/2007 Kubo et al.
7,205,406 B2 4/2007 Kataoka et al.
7,206,525 B2 4/2007 Kin et al.
7,206,526 B2 4/2007 Kobayashi
7,206,530 B2 4/2007 Yang et al.
7,206,533 B2 4/2007 Kwon
7,208,252 B2 4/2007 Grande et al.
7,208,253 B2 4/2007 Mayer et al.
7,208,255 B2 4/2007 Kim et al.
7,208,256 B2 4/2007 Tanaka et al.
7,209,687 B2 4/2007 Sudo et al.
7,209,688 B2 4/2007 Arai
7,209,689 B2 4/2007 Matsumoto et al.
7,209,698 B2 4/2007 Tawada et al.
D541,847 S 5/2007 Katsuyama
D542,837 S 5/2007 Amano
7,211,362 B2 5/2007 Chen et al
7,211,617 B2 5/2007 Kimura et al.
7,212,752 B2 5/2007 Hirota et al.
7,212,764 B2 5/2007 Sato et al.
7,214,412 B2 5/2007 Nishiguchi et al.
7,214,458 B2 5/2007 Mang et al.
7,214,459 B2 5/2007 Iizuka et al.
7,214,460 B2 5/2007 Ishii et al.
7,214,461 B2 5/2007 Yamashita et al.
7,214,463 B2 5/2007 Patel et al.
7,215,910 B2 5/2007 Landa et al.
7,217,485 B2 5/2007 Hasegawa et al.
7,217,486 B2 5/2007 Kato et al.
7,217,487 B2 5/2007 Nanya et al.
7,217,488 B2 5/2007 Mikuriya et al.
7,218,879 B2 5/2007 Enoki et al.
7,218,880 B2 5/2007 Yanagisawa et al.
7,220,524 B2 5/2007 Heilman et al.
7,220,525 B2 5/2007 Riley et al.
7,221,880 B2 5/2007 Jeong et al.
7,221,881 B2 5/2007 Do
7,221,886 B1 5/2007 Miller
7,221,887 B2 5/2007 Kimura et al.
7,223,508 B2 5/2007 Nagase et al.
7,223,509 B2 5/2007 Kubo
7,223,510 B2 5/2007 Matsui et al.
7,224,914 B2 5/2007 Ushiroji et al.
7,224,916 B2 5/2007 Iwakawa
7,224,917 B2 5/2007 Julien et al.
7,226,714 B2 6/2007 Ota
7,226,984 B2 6/2007 Iwata
7,228,080 B2 6/2007 Hamby et al.
7,228,092 B2 6/2007 Nomura et al.
2002/0011185 A1 1/2002 Belmont
2002/0055554 A1 5/2002 Devonport
2004/0185362 A1* 9/2004 Arthur et al. ..... 430/108.21
2006/0154166 A1 7/2006 Tsunemi et al.
2006/0172212 A1 8/2006 Step et al.

FOREIGN PATENT DOCUMENTS

WO WO 95/08658 3/1995
WO WO 96/37547 11/1996
WO WO01/30918 A1 5/2001

OTHER PUBLICATIONS

Hansen, C.M., "Cohesion Parameters for Surfaces, Pigments, and Fillers," Surface Coatings International, 1997 (8), pp. 386-391.

Hansen, Charles M., "Solubility Parameters—An Introduction" and "Methods of Characterization for Pigments, Fillers, and Fibers," Hansen Solubility Parameters: A User's Handbook, pp. 1-2 and 125-135, 2007.

* cited by examiner

Optical image of Modified Carbon black 1
(phenyl-modified R660) in styrene acrylate toner polymer Optical image of R660 in styrene acrylate toner polymer Dispersion of Modified Carbon Black 2
(R330 surface modified with 4-F-aniline) in polyester film Optical image of polymer modified R660 in styrene acrylate toner polymer Dispersion of Regal 330 with adsorbed Joncryl 611 resin in polyester film

CARBON BLACKS, TONERS, AND COMPOSITES AND METHODS OF MAKING SAME

This patent application claims the benefit of U.S. Provisional Patent Application No. 60/942,948 filed Jun. 8, 2007, and is incorporated in its entirety by reference herein.

BACKGROUND OF THE INVENTION

The present invention relates to toner compositions comprising modified pigments. The present invention further relates to processes for preparing toners and the toners resulting from these processes. Also, the present invention relates to composites containing at least one filler or reinforcing agent, such as in particulate form. The present invention further relates to methods of preparing various composites, such as polymer matrixes containing at least one filler or reinforcing agent. Also, the present invention relates to methods of selecting one or more fillers or reinforcing agents based on compatibility with the matrix.

Electrophotographic processes and image-forming apparatus are currently widespread. In electrophotography, an image comprising an electrostatic field pattern (also referred to as an electrostatic latent image), usually of nonuniform strength, is formed on an insulative surface of an electrophotographic element. The insulative surface typically comprises a photoconductive layer and an electrically conductive substrate. The electrostatic latent image is then developed or visualized into an image by contacting the latent image with a toner composition. Generally, the toner composition contains a resin and a colorant, such as a pigment. The toner image is then transferred onto a transfer medium such as paper and fixed thereon by heating and/or pressure. The last step involves cleaning residual toner from the electrophotographic element.

In general, conventional dry toner compositions are prepared by combining a polymeric resin and a colorant followed by mechanical grinding (particle size attrition). The grinding process typically results in uncontrolled breakage of the particles, yielding toner compositions having irregular shapes with relatively wide particle size distributions.

There is a growing need in the industry for toner compositions that can produce images having improved print quality using lower amounts of dry toner per page. In order to meet these needs, efforts have been made to improve the dispersibility of the colorant in the resin and reducing the overall particle size of the toner composition. However, the current mechanical grinding processes are not able to efficiently produce small particle size toners since the energy consumed in grinding typically increases exponentially with the particle size. Also, the irregularly shaped conventional toner particles cannot pack as well as regularly shaped particles, resulting in higher waste of toner per page.

For this reason, various processes have been developed which produce toner particles having small and/or regular shapes. These processes involve the formation of resin particles in the presence of the colorant. Toners produced using such "in situ" processes are often referred to as "chemically prepared toners" or CPTs. For example, a process has been developed in which a polymer latex is combined with an aqueous pigment dispersion and agglomerated using a coagulant to form polymer particles. Another process involves the aqueous suspension polymerization of a dispersion of pigment in at least one monomer. Also, a pigment/polyester resin dispersion has been prepared and combined with water, followed by evaporation of the solvent. Each of these processes results in small particle size toner compositions having regular shapes. However, for each of these processes, since smaller particles result, the dispersibility of the colorant in the polymer becomes very important in order to maintain or improve the properties of the toner. To provide good dispersibility, high levels of dispersants must be included in the chemical toner processes. This has a negative impact on the overall performance of the toner composition, particularly the viscosity of the mixtures used to prepare the toners as well as the moisture sensitivity of the resulting chemical toner. Other issues have also been found.

Modified pigments having attached organic groups have been disclosed for use in toner compositions. For example, U.S. Pat. No. 6,218,067 discloses, in part, a toner composition comprising the product of a mixture of resin particles and chargeable modified pigment particles. The modified pigment particles comprise at least one organic ionic group attached to the pigment particles and at least one amphiphilic counterion. Also, U.S. Pat. Nos. 5,955,232 and 6,054,238 disclose, in part, toner compositions comprising resin particles and modified pigment particles having attached at least one positively chargeable organic group. In addition, U.S. Patent Publication No. 2002-0011185 discloses, in part, a modified pigment product comprising a pigment having attached at least one organic group represented by the formula —X-Sp-Alk, wherein X, which is directly attached to the pigment, represents an arylene, heteroarylene, or alkylene group, Sp represents a spacer group, and Alk represents an alkenyl or alkyl group containing 50-200 carbon atoms. Toner compositions are also disclosed. Furthermore, U.S. Pat. Nos. 6,337,358 and 6,372,820 and U.S. Patent Publication No. 2002-0055554 disclose, in part, toner compositions comprising modified particles having attached polymeric groups. While these previous inventions describe the use of toners containing pigments having particular types of attached organic groups, none of these patents/publications take into consideration the need to have excellent compatibility of the pigment with attached organic group with the polymer components of the toner. For instance, one cannot simply use any attached organic group on a pigment and achieve an acceptable toner composition. An attached organic group may not be compatible with the polymer components of the toner composition. Phase separation of the organic group may occur where the organic group separates or the organic groups on the pigment cause an agglomeration of the pigments when added to the polymer components thereby preventing the formation of chemical toner particles. Accordingly, particular types of organic groups paired with the remaining parts of the toner composition need to be developed which will avoid these additional problems and disadvantages. There also remains a need for toners, in particular chemical toners, with properties capable of meeting the increasingly demanding print performance, efficiency, and cost requirements of the industry.

SUMMARY OF THE PRESENT INVENTION

A feature of the present invention is to provide a chemical toner composition.

Another feature of the present invention is to provide a toner composition that provides a uniform dispersion of the pigment throughout the toner composition and preferably has no agglomerates or few agglomerates of the pigment present in the toner composition.

An additional feature of the present invention is to provide a means to disperse one or more pigments in one or more polymers to form a chemical toner composition.

A further feature of the present invention is to provide a means to select proper fillers so that they are compatible with emulsion polymers or suspension polymers in the formation of a chemical toner.

Another feature is to provide a polymer composite that is a chemical toner for electrophotography having improved fixing properties, such as lower toner fixing temperature.

Additional features and advantages of the present invention will be set forth in part in the description that follows, and in part will be apparent from the description, or may be learned by practice of the present invention. The objectives and other advantages of the present invention will be realized and attained by means of the elements and combinations particularly pointed out in the description and appended claims.

To achieve these and other advantages, and in accordance with the purposes of the present invention, as embodied and broadly described herein, the present invention relates to toner compositions, particularly chemically prepared toner compositions, comprising a resin and a colorant. In one embodiment, the colorant is a modified colorant (e.g., modified pigment) comprising a colorant having attached at least one organic group having one of the formulas: —Ar, —Ar-$Alk_x$,

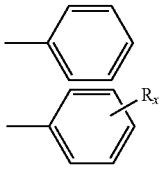

where R is Alk, $C_nH_{2n+1}$ or $C_nH_{2n}$ or $C_nH_{2n-1}$ and x is from 1 to 5

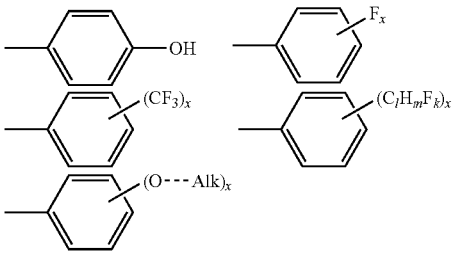

Where Ar is an aryl or arylene group, Alk is an alkyl or alkylene group, such as an unsubstituted or substituted alkyl or alkylene group, x is an integer of 1 to 5, n is an integer of 1 to 5, 1 is an integer of 1 to 5, k is an integer of 1 to 10, m is 10-k, and where x is 2 or more, each of the substituents can be the same or different. The modified colorant can be a colorant with at least one adsorbed polymer on the colorant's surface, such as a polymer that is a phenyl containing polymer, such as a polystyrene, a poly(styrene-acrylate), a polyester, or a poly (phenylmethylsiloxane). The toner composition can have a substantially smooth surface and/or a particle size from about 3 to about 10 microns.

The present invention further relates a process for preparing a toner composition, particularly a chemical toner composition, comprising the steps of: i) combining an aqueous dispersion comprising a colorant, an aqueous emulsion comprising at least one polymer, and an optional wax to form a mixture, ii) forming a coagulated toner from the mixture; and iii) heating the coagulated toner above the Tg of the polymer to form a toner. The colorant can be the modified colorant as described above and herein. The process may further comprise the step of encapsulating the toner. The present invention further relates to the toner composition produced by this process.

The present invention further relates a process for preparing a toner composition, particularly a chemical toner composition, comprising the steps of: i) forming a dispersion of a colorant in at least one monomer; ii) forming a suspension of the dispersion in an aqueous medium; and iii) polymerizing the suspension to form a toner. The colorant can be the modified colorant described above and herein. The process may further comprise the step of encapsulating the toner. The present invention further relates to the toner composition produced by this process.

The present invention further relates a process for preparing a toner composition, particularly a chemical toner composition, comprising the steps of: i) forming a dispersion of a colorant in a polymer solution comprising at least one non-aqueous solvent and at least one polyester; ii) forming an emulsion of the dispersion in an aqueous medium; and iii) evaporating the solvent to form a toner. The colorant can be the modified colorant as described above and herein. The process may further comprise the step of encapsulating the toner. The present invention further relates to the toner composition produced by this process.

The present invention also relates to a polymer composite that is chemical toner for electrophotography having improved fixing properties. The chemical toner is prepared with treated colorant that is dispersed in at least one polymer, such as an emulsion or suspension polymer. In one embodiment, the surface-modified colorant can be treated carbon black. Chemical toner prepared with treated colorants such as a treated carbon black can have a lower fixing temperature than chemical toner prepared with conventional carbon black, such as carbon black without attached chemical groups.

It is to be understood that both the foregoing general description and the following detailed description are exemplary and explanatory only and are intended to provide a further explanation of the present invention, as claimed.

The accompanying drawings, which are incorporated in and constitute a part of this application, illustrate some of the embodiments of the present invention and together with the description, serve to explain the principles of the present invention.

DETAILED DESCRIPTION OF THE PRESENT INVENTION

Figure 1:
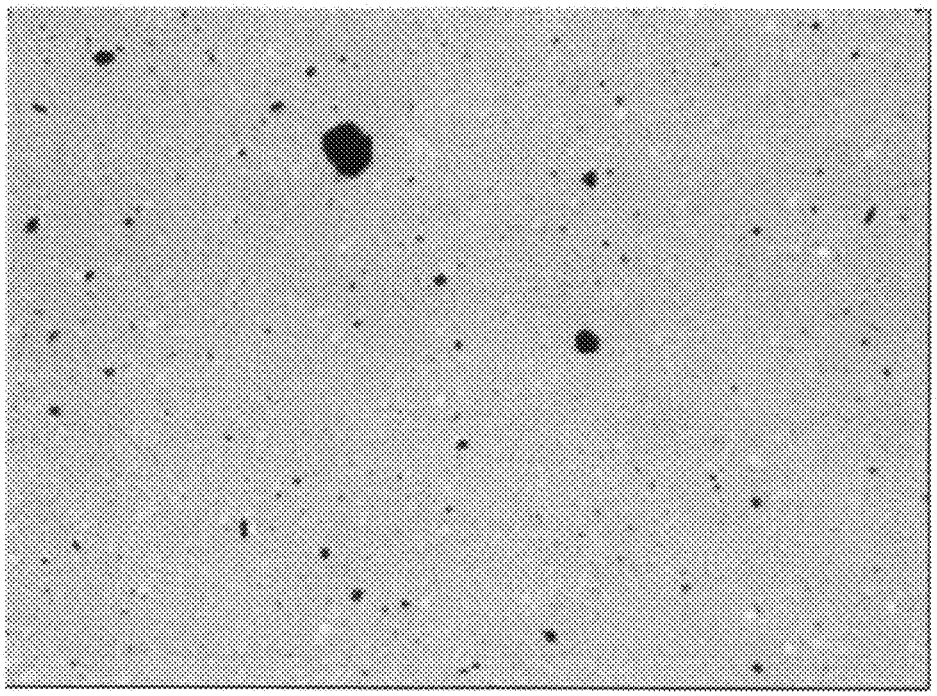
FIGS. 1-5 are optical images of dispersions containing either the modified colorants with toner polymer of the present invention or unmodified colorant with toner polymer

The present invention relates in part to toner compositions, in particular, chemical toner compositions, as well as processes for preparing them.

The toner compositions of the present invention comprise a resin and a colorant and are preferably "chemical toners" or "chemically prepared toners" (CPTs), which, as defined herein, are toners having small and/or regular shapes. Contrary to conventional toner compositions, which are produced by combining a resin and a colorant followed by pulverization, chemical toners are typically prepared by processes involving the formation of toner particles in the presence of a colorant and a solvent, preferably an aqueous solvent, and do not require the use of a pulverization step. Current mechanical grinding processes used to prepare conventional toner compositions are not able to efficiently produce small particle size toners since the energy consumed in grinding typically increases exponentially with the particle size. Also, irregularly shaped particles result from the conventional grinding processes, which cannot pack as well as regularly shaped particles, resulting in higher waste of toner per page. The toner compositions of the present invention are preferably chemical toners having small and/or regular shapes since the particles are not produced using a pulverization step, as in conventional toner compositions.

The resins may be any resin known in the art and are preferably toner resins or polymers. Suitable resin materials include, for example, polyamides, polyolefins, polycarbonates, styrene acrylates, styrene methacrylates, styrene butadienes, crosslinked styrene polymers, epoxies, polyurethanes, vinyl resins, including homopolymers or copolymers of two or more vinyl monomers, polyesters and mixtures thereof. In particular, the resin may include homopolymers of styrene and its derivatives and copolymers thereof such as polystyrene, poly-p-chlorostyrene, polyvinyltoluene, styrene-p-chlorostyrene copolymers, styrene-vinyltoluene copolymers, copolymers of styrene and acrylic acid esters such as methyl acrylate, ethyl acrylate,-n-butyl acrylate, and 2-ethylhexyl acrylate, copolymers of styrene and methacrylic acid esters such as methyl methacrylate, ethyl methacrylate, n-butyl methacrylate, and 2-ethylhexyl methacrylate, copolymers of styrene, acrylic acid esters and methacrylic acid esters, or copolymers of styrene with other vinyl monomers such as acrylonitrile (styrene-acrylonitrile-indene copolymers), vinyl methyl ether, butadiene, vinyl methyl ketone, and maleic acid esters. The resin may also be a polymethyl methacrylate resin, polybutyl methacrylate resin, a polyvinyl acetate resin, a polyvinyl butyral resin, a polyacrylic acid resin, a phenolic resin, an aliphatic or alicyclic hydrocarbon resin, a petroleum resin, or a chlorin paraffin. The resin may also be a polyester resin, such as copolyesters prepared from terephthalic acid (including substituted terephthalic acid), a bis[(hydroxyalkoxy)phenyl]alkane having from 1 to 4 carbon atoms in the alkoxy radical and from 1 to 10 carbon atoms in the alkane moiety (which can also be halogen-substituted alkane), and alkylene glycol having from 1 to 4 carbon atoms in the alkylene moiety. Any of these resin types may be used either individually or as mixtures with these or other resins.

The resin is generally present in an amount from about 60% to about 95% by weight of the total toner composition. Generally, resins particularly suitable for use in xerographic toner manufacturing have a melting point in the range of between about 100° C. and about 135° C. and/or have a glass transition temperature (Tg) greater than about 60° C.

The toner composition of the present invention also comprises a colorant. In one embodiment, the colorant is a modified pigment comprising a pigment having attached at least one organic group. The pigment of this modified pigment can be any type of pigment conventionally used by those skilled in the art, such as carbonaceous black pigments or other black pigments and other colored pigments including blue, black, brown, cyan, green, white, violet, magenta, red, orange, or yellow pigments. Mixtures of different pigments can also be used. Representative examples of black pigments include various carbon blacks (Pigment Black 7) such as channel blacks, furnace blacks and lamp blacks, and include, for example, carbon blacks, such as the brands the Regal®, Black Pearls®, Elftex®, Monarch®, Mogul®, and Vulcan® trademarks available from Cabot Corporation (such as Black Pearls® 2000, Black Pearls® 1400, Black Pearls® 1300, Black Pearls® 1100, Black Pearls® 1000, Black Pearls® 900, Black Pearls® 880, Black Pearls® 800, Black Pearls® 700, Black Pearls® L, Elftex® 8, Monarch® 1400, Monarch® 1300, Monarch® 1100, Monarch® 1000, Monarch® 900, Monarch® 880, Monarch® 800, Monarch® 700, Mogul® L, Regal® 330, Regal® 400, Vulcan® P). Suitable classes of colored pigments include, for example, anthraquinones, phthalocyanine blues, phthalocyanine greens, diazos, monoazos, pyranthrones, perylenes, heterocyclic yellows, quinacridones, quinolonoquinolones, and (thio)indigoids. Such pigments are commercially available in either powder or press cake form from a number of sources including, BASF Corporation, Engelhard Corporation and Sun Chemical Corporation. Examples of other suitable colored pigments are described in the Colour Index, 3rd edition (The Society of Dyers and Colourists, 1982). Preferably the pigment is a cyan, magenta, or yellow organic pigment or a carbonaceous black pigment, such as carbon black. These pigments can also be used in combination with a variety of different types of dispersants in order to form stable dispersions.

The colorant (e.g, pigment or filler) can have conventional surface areas, iodine numbers, particle sizes, oil absorption, DPBA, crushed DPBA, and the like. The pigment can have a wide range of BET surface areas, as measured by nitrogen adsorption, depending on the desired properties of the pigment. For example, the pigment may be a carbon black having a surface area of from about 10 to 600 $m^2/g$, such as from about 20 to 250 $m^2/g$ and about 20 to 100 $m^2/g$. A higher surface area will correspond to a smaller primary particle size. The pigment can also have a wide variety of primary particle size of from about 5 nm to about 100 nm, including from about 10 nm to about 80 nm, and 15 nm to about 50 nm. If, for example, a higher surface area for a colored pigment is not readily available for the desired application, the pigment may be subjected to conventional size reduction or comminution techniques, such as ball or jet milling, to reduce the pigment to a smaller particle size, if desired.

The pigment can also have a wide range of dibutylphthalate absorption (DBP) values, which is a measure of the structure or branching of the pigment. For example, the pigment may be a carbon black having a DBP value of from about 30 to 100 mL/100 g, including from about 40 to 90 mL/100 g and from about 40 to 80 mL/100 g. In addition, the pigment may have a wide range of primary particle sizes, such as from about 10 to 100 nm, including from about 15 to 60 nm. Fillers with other shapes may also be used. In one or more embodiments, the filler, such as the carbon black, has a PAH of less than 10 ppm and can be less than 5 ppm or less than 1 ppm.

Also, for purposes of the present invention, the carbon product to be modified can be an aggregate comprising a carbon phase and a silicon-containing species phase. A description of this aggregate as well as means of making this aggregate are described in PCT Publication No. WO 96/37547 as well as U.S. Pat. Nos. 6,364,944; 6,323,273; 6,211,279; 6,191,194; 6,172,154; 6,057,387; 6,028,137; 6,008,272; 5,977,213; 5,948,835; 5,919,841. All patents, publications, and patent applications throughout are hereby incorporated in their entireties herein by reference.

The carbon product to be modified, for purposes of the present invention, can be an aggregate comprising a carbon phase and metal-containing species phase where the metal-containing species phase can be a variety of different metals such as magnesium, calcium, titanium, vanadium, cobalt, nickel, zirconium, tin, antimony, chromium, neodymium, lead, tellurium, barium, cesium, iron, molybdenum, aluminum, and zinc, and mixtures thereof. The aggregate comprising the carbon phase and a metal-containing species phase is described in U.S. Pat. No. 6,017,980, also hereby incorporated in its entirety herein by reference.

Also, for purposes of the present invention, a carbon product to be modified can be a silica-coated carbon black, such as that described in PCT Publication No. WO 96/37547, published Nov. 28, 1996, also incorporated in its entirety herein by reference.

The pigment to be modified may also be a pigment that has been oxidized using an oxidizing agent. Oxidizing agents include, but are not limited to, oxygen gas, ozone, peroxides such as hydrogen peroxide, persulfates, including sodium and potassium persulfate, hypohalites such a sodium hypochlorite, oxidizing acids such a nitric acid, and transition metal containing oxidants, such as permanganate salts, osmium tetroxide, chromium oxides, or ceric ammonium nitrate. Mixtures of oxidants may also be used, particularly mixtures of gaseous oxidants such as oxygen and ozone. Other surface modification methods, such as chlorination and sulfonylation, may also be used prior to modifying the colorant with an attached organic group as described herein.

With respect to the modified colorant (e.g., modified pigment), the modified colorant (e.g., pigment or filler) comprises a colorant having attached at least one organic group having one of the formulas: —Ar, —Ar-$Alk_x$,

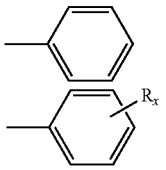

where R is Alk, $C_nH_{2n+1}$ or $C_nH_{2n}$ or $C_nH_{2n-1}$ and x is from 1 to 5

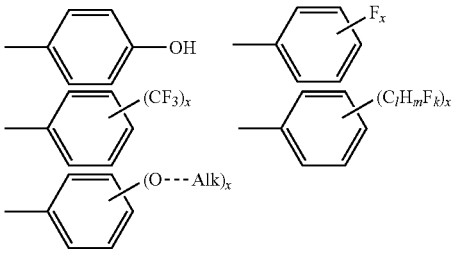

where Ar is an aryl or arylene group, Alk is an alkyl or alkylene group, such as an unsubstituted or substituted alkylene group, x is an integer of 1 to 5, n is an integer of 1 to 5, 1 is an integer of 1 to 5, k is an integer of 1 to 10, m is 10-k, and where x is 2 or more, each of the substituents on the aryl ring can be the same or different. The organic groups are preferably directly attached to the colorant and the open bond in the structures/formulas herein represents an available bond that attaches (e.g., bonds) preferably to the colorant (e.g., pigment). These groups are preferably directly attached to the colorant (e.g., pigment). The "attachment" is preferably a chemical attachment or bonding to the colorant particle, such as a covalent bond. The groups that are attached are preferably non-polymeric.

The group Ar represents an aryl or arylene or heteroaryl or heteroarylene group. Ar is preferably directly attached to the pigment. Preferably, the aryl is phenyl, naphthyl or biphenyl, and/or the arylene or heteroarylene group is phenylene, naphthylene, or biphenylene.

The group Ar can be further substituted with other groups, such as one or more alkyl groups or aryl groups. Also, the group Ar may be substituted with one or more functional groups, such as non-ionic groups. Examples of functional groups include, but are not limited to, R, OR, COR, COOR, OCOR, wherein R, which can be the same or different, is independently hydrogen, branched or unbranched $C_1$-$C_{20}$ substituted or unsubstituted, saturated or unsaturated hydrocarbons, e.g., alkyl, alkenyl, alkynyl, substituted or unsubstituted aryl, substituted or unsubstituted heteroaryl, substituted or unsubstituted alkaryl, or substituted or unsubstituted aralkyl.

The group Alk represents an alkyl or alkylene group or heteroalkyl or heteroalkylene group and can be a $C_1$ to $C_{12}$ alkyl or alkylene group, such as, but not limited to, methyl, ethyl, propyl, butyl, hexyl, methylene, ethylene, propylene, butylene, pentylene, hexylene, and the like. The alkyl or alkylene group can optionally be substituted with one or more functional groups as described above for the Ar group.

The modified colorant can be a colorant with at least one adsorbed polymer on the colorant's surface, such as a polymer that is a phenyl containing polymer, such as a polystyrene, a poly(styrene-acrylate), a polyester, or a poly(phenylmethylsiloxane). The colorant that is modified can be any of the ones described herein. The polymer can be adsorbed on the entire surface of the colorant or a portion thereof. More than one type of polymer can be adsorbed onto the colorant (e.g., mixtures).

For purposes of the present invention, the modified colorant may be identified herein as a treated filler or modified pigment. The modified colorants of the present invention do not contain any ionic or ionizable group as part of the organic group. Preferably the organic groups identified herein are not modified further with any other organic groups or ionizable groups. The toner composition preferably does not contain any surfactants and/or dispersants or contains low or negligible amounts, such as from 0.001 wt % to 1 wt %, or less than 0.001 wt %, or from 0.0001 wt % to 0.05 wt % based on the weight of the toner composition.

The following alkoxy silane materials can be used as the precursor to attached silane chemical groups to the filler, such as carbon black. The attachment is generally by removal of one of the methoxy or alkoxy groups, and then bonding to the filler surface. The mechanism can be the same for alkoxy groups in general. By alkoxy silane is meant a silane molecule with at least one and not more than three alkoxy functionalities attached directly to the silicon atom.

Alkoxy Silanes (3,3,3-trifluoropropyl)trimethoxysilane
10-undecenyltrimethoxysilane
1-naphthyltrimethoxysilane
2-(4-pyridylethyl)triethoxysilane
3-thiocyanatopropyltriethoxysilane
3-trifluoroacetoxypropyltrimethoxysilane
n-octadecyldimethylmethoxysilane
p-tolyltrimethoxysilane
styrylethyltrimethoxysilane
tridecafluoro-1,1,2,2-tetrahydrooctyl)trimethoxysilane
triethoxyfluorosilane
trimethoxy(methylphenoxy)silane
ureidopropyltrimethoxysilane
vinyltrimethoxysilane
n-(n-butyl)-3-aminopropyltrimethoxysilane
hexadecyltrimethoxysilane
3-aminopropyltrimethoxysilane
n-2-aminoethyl-3-aminopropyltrimethoxysilane
3-glycidyloxypropyltrimethoxysilane
3-methacryloxypropyltrimethoxysilane 3-mercaptopropyltrimethoxysilane
octyltrimethoxysilane
propyltrimethoxysilane
methacryloxypropyltrimethoxysilane
vinylbenzylaminoethylaminopropyltrimethoxysilane
mercaptopropyltrimethoxysilane
chloropropyltrimethoxysilane
benzylaminoethylaminopropyltrimethoxysilane
vinylbenzylaminoethylaminopropyltrimethoxysilane
n-hexyltrimethoxysilane With respect to forming the treated filler and examples of treated filler (e.g., colorant), a variety of techniques can be used to chemically modify the surface of the filler. For instance, diazonium treatments or radical additions can be used to chemically attach one or more chemical groups onto the surface of the filler. Physical blending can be used for chemical adsorption. Also, a linker group can be placed on a polymer(s) so that the polymer physiosorbs to the filler surface.

With respect to physical blending, this involves dissolving a polymer in a solvent and dispersing a filler, such as carbon black, in the solvent, and using, for instance, a rotostator or similar equipment to break down the agglomerates. The solvent chosen is preferably a good solvent for the polymer, that is $\theta>0.5$. A good solvent will cause the polymer to extend and the exclusion volume to be larger. Thus, the viscosity of the polymer solution will increase. With the proper selection of a solvent, known as a good solvent, one has the ability to coat or physio-absorb a chemical onto the filler, e.g., carbon black. In lieu of a polymer, any chemical can be chosen to coat the carbon black in this manner. This treated filler can be added to the polymer system to form the composite. A good solvent for the polymer is one that the actual dimension will exceed the unperturbed dimensions of the polymer which is commonly described as $\theta>0.5$ in the Mark-Houwink-Sakurada equation. (ref: Polymer Chemistry, M. P. Stevens, Oxford Press 1990).

Another method employed to physiosorb a polymer onto the surface of the filler is to mix a polymer emulsion and a filler in pelletizer, then remove the water, such as with the use of an oven.

With respect to diazonium treatment, a method that can be used to attach a chemical group to the filler can be a diazonium treatment as detailed, for instance, in the following patents: U.S. Pat. Nos. 6,852,158; 6,664,312; 6,551,393; 6,534,569; 6,372,820; 6,368,239; 6,350,519; 6,337,358; 6,103,380; 7,173,078; 7,056,962; 6,953,825; 6,942,724; 6,936,097; 6,929,889; 6,911,073; 6,494,943; 6,478,863; and 6,472,471. These patents describe methods for the attachment of organic groups to fillers, such as pigments, by way of an attachment via a diazonium reaction where the organic group can be part of the diazonium salt. For purposes of at least one embodiment of the present invention, the amount of organic group attached to the filler (e.g. carbon black) can be helpful for purposes of adjusting the solubility parameter of the treated filler for use in the matrix and can, for instance be useful in such applications as toners, tire formulations, adhesives, cable compositions, ink jet ink compositions, reinforced and expandable polyurethanes, coating formulations, and ink systems. In particular, the levels can be any treatment level and can be a low level. The treatment levels of chemical group may be from about 0.10 to about 4.0 micromoles/$m^2$ of the filler (e.g. carbon black) used, based on the surface area of the filler. Furthermore, the treated filler can be formed by using the diazonium and stable free radical methods described, for instance, in U.S. Pat. Nos. 6,068,688; 6,337,358; 6,368,239; 6,551,393; 6,852,158, which makes use of reacting at least one radical with at least one particle, wherein a radical is generated from the interaction of at least one transition metal compound with at least one organo-halide compound in the presence of one or more particles capable of radical capture, and the like.

Further, a siloxane treatment can be used to attach a variety of chemical groups wherein the attachment typically occurs through a siloxy radical, such as Si—O—. This technique is described, for instance, in U.S. Pat. Nos. 6,964,992; 6,174,926; 6,159,540; 6,090,439.

Further, radical addition can be used to attach chemical groups onto the surface of the filler. This technique is described, for instance, in U.S. Pat. No. 4,014,844.

Further, an epoxy reaction can be used to attach chemical groups. For instance, this process is described in EP 0749991 and EP 0272127 can be used.

Any other manner in which to attach chemical groups or otherwise modify the surface of the filler with one or more chemicals can be used in the present invention.

The amount of attached organic groups and/or adsorbed polymer can be varied in order to attain the desired performance attributes. This allows for greater flexibility in optimizing performance properties. Preferably, the total amount of attached organic groups and/or adsorbed polymer is from about 0.001 to about 10.0 micromoles of organic group/$m^2$ surface area of pigment, as measured by nitrogen adsorption (BET method). More preferably, the amount of attached organic groups and/or adsorbed polymer is from about 0.01 to about 5.0 micromoles/$m^2$ and most preferably is from about 0.05 to 3.0 micromoles/$m^2$. In addition, the modified pigments may further comprise additional attached organic groups. This can result in further improved properties.

In addition, mixtures of modified colorants (e.g., modified pigments) can be used. Thus, the toner composition of the present invention may comprise two or more modified colorants, e.g., modified pigments, wherein each of the modified colorants has an attached organic group and/or adsorbed polymer. The two modified colorants, e.g., modified pigments can differ in the type of attached group and/or adsorbed polymer, the amount of attached group and/or adsorbed polymer, the type of pigment and/or adsorbed polymer, or combinations thereof. Thus, for example, two modified pigments, each having an attached organic group comprising different groups may be used together. Also, two modified pigments, each comprising a different pigment (such as two carbon blacks each having different surface areas and/or structures) and having the same attached organic group and/or adsorbed polymer may be used together. Other combinations of modified pigments can be used.

It has been found that the disclosed colorants have unforeseen advantages over both conventional colorants. For example, the use of the modified pigments described herein has been found to allow for reduced levels of dispersants needed for ensuring that the colorant disperses well in the resin. By comparison, conventional colorants require a higher level of dispersants. Lowering the amount of dispersant results in a colorant dispersion with a lower viscosity, which results in processing (ease of use) and economic advantages (for example, increased levels of colorant) as well as product performance enhancements for the final toner composition, including improved environmental stability (for example, sensitivity to humidity). The modified pigments described herein also provide both processing and economic advantages.

In the present invention, the toner composition comprising a resin and a colorant is preferably a chemically prepared toner, also referred to as a chemical toner. Thus, the toner composition can have a smooth surface, a mean particle size of from about 3 and about 10 microns, or both. By smooth surface is meant that the toner has substantially no sharp or jagged edges, such as those that arise by the comminuting of large particles into smaller particles. The shape of the toner composition may be any having a smooth surface, but is preferably a shape having no corners or edges, such as spheroidal or ellipsoidal shape, including egg-shaped or potato-shaped. These 3-dimensional rounded shapes preferably have an aspect-ratio of about 1.0 to about 3.0, more preferably about 1.0 to about 2.0, and most preferably from about 1.2 to about 1.3.

The toner compositions of the present invention may further comprise optional additives that may also be mixed or blended into one or more of the components used to prepare these compositions, described in more detail below. Examples include carrier additives, positive or negative charge control agents such as quaternary ammonium salts, pyridinium salts, sulfates, phosphates, and carboxylates, flow aid additives, silicone oils, and/or waxes such as commercially available polypropylenes and polyethylenes. The toner composition can further comprise iron oxide or other metal, wherein the iron oxide can be magnetite, thus making the toner composition a magnetic toner composition. Generally, these additives are present in amounts of from about 0.05 by weight to about 30% by weight, however, lesser or greater amounts of the additives may be selected depending on the particular system and desired properties.

The present invention further relates to a process for preparing toner compositions, as well as to the toner compositions produced by this process. In one embodiment, the process of the present invention comprises the steps of forming a coagulated toner comprising at least one polymer and at least one modified colorant and subsequently heating this to a temperature above the Tg of the polymer, to form a toner. The modified colorant may be any of the modified colorants described herein.

The coagulated toner is prepared by combining an aqueous dispersion of the colorant and an aqueous emulsion of the polymer, along with at least one coagulant. An optional wax may also be added. Suitable coagulants include, for example, salts (such as polyaluminum chloride, polyaluminum sulfosilicate, aluminum sulfate, magnesium sulfate, or zinc sulfate), or surfactants, including cationic surfactants such as, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, or $C_{17}$ trimethyl ammonium bromides, the halide salts of quaternized polyoxyethylalkylamines, or dodecylbenzyl triethyl ammonium chloride. Mixtures of these may also be used. The coagulant, which can be used in an amount of, for example, from about 0.01 to about 10 percent by weight of toner, causes the formation of aggregated particles of polymer and colorant. Coagulation may also be caused by a change in pH. Thus, the coagulant may be an acid or a base, depending on the pH of the aqueous colorant dispersion and/or the aqueous polymer emulsion. In addition, the coagulated toner may be formed using mechanical or physical means, including, for example, spray drying the mixture comprising the aqueous colorant dispersion and aqueous polymer emulsion.

The resulting coagulated toner is then heated above the Tg of the polymer for a time and temperature sufficient to form a toner composition. Preferably, the heating step occurs under conditions in which the mean particle size of the toner is from about 3 to about 10 microns and/or in which the toner has a substantially smooth surface. Further details concerning specific aspects of this process can be found in, for example, U.S. Pat. Nos. 6,562,541; 6,503,680; and 5,977,210, all of which are incorporated in their entirety by reference herein.

In a second embodiment, the process for preparing a toner composition comprises the steps of forming a dispersion of a modified colorant in at least one monomer and suspending this dispersion in an aqueous medium, especially water. An initiator is also added, either in the colorant dispersion or after forming the aqueous suspension, but is preferably added in the colorant dispersion. Other optional components, such as stabilizers, may also be added. The resulting suspension is then polymerized to form a toner. For the present invention, the modified colorant may be any of the modified colorants described in more detail above. The monomer may be any of those used to prepare the resin materials described above for the toner compositions of the present invention. Preferably, the polymerization occurs under conditions in which the mean particle size of the toner is from about 3 to about 10 microns and/or in which the toner has a substantially smooth surface. Further details concerning specific aspects of this process can be found in, for example, U.S. Pat. Nos. 6,440,628; 6,264,357; 6,140,394; 5,741,618; 5,043,404; 4,845,007; and 4,601,968, all of which are incorporated in their entirety by reference herein.

In a third embodiment, the process for preparing a toner composition comprises the steps of forming a dispersion of a modified colorant in a polymer solution comprising at least one non-aqueous solvent and at least one polyester, forming an aqueous emulsion of this dispersion in an aqueous medium, such as water, and evaporating the solvent to form a toner. Other optional components, such as dispersing aids and emulsion stabilizers, may also be added, either in the colorant dispersion or after forming the aqueous emulsion. For the present invention, the modified colorant may be any of the colorants described in more detail above relating to the toner compositions of the present invention. The polyester may be any of those used for preparing toner compositions, particular the toner compositions of the present invention, described in more detail above. Preferably, the emulsion forming process, in combination with the solvent evaporation, occurs under conditions in which the mean particle size of the toner is from about 3 to about 10 microns and/or in which the toner has a substantially smooth surface. Further details concerning specific aspects of this process can be found in, for example, U.S. Pat. Nos. 6,787,280 and 5,968,702, all of which are incorporated in their entirety by reference herein.

For each embodiment of the process of the present invention, an additional step of encapsulating the toner may be used. Encapsulation results in the formation of a polymer shell around the toner, producing a toner having a core/shell structure. Any process for encapsulation known in the art can be used. The polymer used as the shell is chosen in order to provide performance and handling properties to the toner. For example, the resulting encapsulated toners may be more easily fused, particularly at lower temperatures, and may also have higher and more uniform charging characteristics. Other properties may also result.

For each embodiment of the process of the present invention, additional purification steps may be included. For example, the toner compositions produced by the processes described above may be washed to remove undesired by-products or impurities and dried. The toners may also be isolated by spray drying, either with or without encapsulation.

The present invention also relates to composites that contain at least one filler and a matrix. The present invention relates also to methods of preparing a composite containing at least one filler and at least one matrix, such that the filler is extremely compatible with the matrix thereby leading to the filler preferably being uniformly dispersed throughout the matrix and, preferably, leading to a low agglomeration or no agglomeration of the filler within the composite. Composite materials (or composites for short) are materials, such as engineering materials, made from two or more constituent materials that typically remain separate and distinct on a macroscopic level while forming a single component. There are two categories of constituent materials: matrix and reinforcement. At least one portion of each type is required. The matrix material surrounds and supports the reinforcement materials by maintaining their relative positions. The reinforcement or reinforcement material can be at least one filler, such as carbon black. The matrix can be at least one polymer, at least one prepolymer, at least one oligomer, or any combination thereof and/or can be other materials.

In more detail, in one or more embodiments, the present invention relates to a method of preparing a composite containing at least one filler and a matrix. The filler can comprise a plurality of one or more types of fillers, such as particulates, powder, pellets, and the like. In the method, the solubility parameter of the material forming the matrix is determined and a filler is selected such that the solubility parameter, as calculated for the surface of the filler or the modified surface of the filler, is within 10% of the solubility parameter for the material forming the matrix. By having the solubility parameter of the filler similar to the solubility parameter of the material forming the matrix, the filler can be wetted by the matrix and the filler can thus be more easily dispersed, even under low shear conditions, throughout the material forming the matrix, which preferably leads to a uniform or substantially uniform dispersion of the filler throughout the matrix and, preferably, leads to a low agglomeration rate and, more preferably, the formation of few agglomerates, and, even more preferably, no agglomeration in the composite.

With respect to the solubility parameter, most polymers have a solubility parameter that can be determined experimentally, or these solubility parameters are readily available (e.g., obtained) in the literature, such as The Polymer Handbook, fourth edition, Editors: J. Brandrup, E. H. Immergut, and E. A. Grulke; Wiley 1999, which is incorporated in its entirety by reference herein. For instance, listed below are solubility parameters for a variety of polymers which can be useful in the present invention in the formation of a polymer composite. The solubility parameters for the filler can be calculated using Hildebrandt, Hansen, or group theory, such as Fedors, Small, or Van Krevelen, and the solubility parameters are pseudo-empirical estimations of the two materials' ability to intermix.

| Polymer | Solubility Parameter (MPa)^½ |
|---|---|
| Poly(butadiene) | 17.1 |
| Poly(butadiene-co-styrene)(85/15) | 17.3 |
| Polypropylene | 18.8 |
| Poly(methacrylic acid), methyl ester | 18.9 |
| Poly(acrylic acid), butyl ester | 18.0 |
| Poly(styrene) | 18.7 |
| Poly(styrene-co-divinylbenzene) 10% crosslinking | 15.7 |
| Nylon 6,6 | 22.9 |
| Poly(2-cyanoethyl acrylate) | 31.8 |
| Poly(propylene oxide) | 16.3 |

These solubility parameters are typically measured in units of $(M\ Pa)^{1/2}$ or √cal/cm. Typically, the solubility parameter for a polymer will range from about 5 to about 14 √cal/cm.

With respect to the solubility parameter for the filler or fillers, this solubility parameter must be calculated since generally a particulate material or solid material does not have a solubility parameter in and of itself. The solubility parameter can be calculated for the filler based on the surface of the filler and the manner in which the filler is optionally treated on its surface. In more detail, preferably, for purposes of the present invention, the filler that is used is a treated filler which is treated chemically, thermally, or mechanically (e.g., physiosorption). Preferably, the filler is treated chemically or mechanically. Depending upon the chemical treatment, the calculated solubility parameter will vary and, therefore, by having the ability to vary the solubility parameter, one has the ability to select a chemical treatment that will provide a calculated solubility parameter that is similar to (e.g., within 10%, within 5%, within 1%) the solubility parameter of the polymer used in the polymer composite. The solubility parameter can be calculated for the filler using what is known as a group theory. This group theory can be calculated using solubility parameter models. For instance, this modeling can be done using the procedure described in The Polymer Handbook, fourth edition, Editors: J. Brandrup, E. H. Immergut, and E. A. Grulke; Wiley 1999. The general method involves subdivision of the surface structure into chemical groups, such as phenyl, methyl, methylene, methine, etc. Then, adding the contribution for each subgroup considering the molecular volume.

In one or more other embodiments, the polymer composite is a chemical toner for electrophotography. The chemical toner contains or is prepared with treated filler that is dispersed in at least one polymer, such as an emulsion or suspension polymer suitable for preparing toner. In one embodiment, the chemical toner contains or is prepared with treated filler that can be, for example, treated carbon black, as described herein. The chemical toner prepared with the treated carbon black can have a lower fixing temperature than chemical toner prepared with conventional carbon black.

In one or more embodiments, the present invention relates to a method of preparing a polymer composite comprising at least one polymer and at least one filler that can be a particulate filler. The method includes determining or obtaining a solubility parameter for the polymer and selecting at least one filler such that the filler has a solubility parameter that is within 10% of the solubility parameter for the polymer. Preferably, the solubility parameter for the filler is within 5% or within 1% or within 0.5% of the solubility parameter of the polymer. When more than one polymer comprises the polymer composite, preferably, the at least one filler has a solubility parameter within 10% of the solubility parameter for the combined (mixed) polymers. However, if desirable, the filler can have a solubility parameter that is within 10% of one of the polymers forming the polymer composite, and this is especially desirable if one wants to selectively have the filler primarily present in only one of the two or more polymers present. Thus, the present invention provides a means for selective dispersion in a composite and this is especially useful when the two or more polymers have different solubility parameters.

As a summary, the modeling used to determine the solubility parameter or calculated solubility parameter of the treated filler takes into account the solubility parameter of the chemical used in the chemical or mechanical treatment and further takes into consideration the molecule that is attached or adsorbed onto the surface of the filler to form the treated filler, which generally is not the exact chemical used in the method of attaching or adsorbing, and further is based on the understanding that a significant portion of the surface of the filler, if not the entire surface, will be covered by the chemical or mechanical modification. By doing this, the solubility parameter can be calculated.

Examples of fillers that can be used in the present invention are any conventional fillers used in any composite. For instance, the filler can be organic or inorganic or found in nature. More particularly, as examples, the filler can be, but is not limited to, carbon black, silica, pigments, metal oxides, and the like. The filler can be a carbonaceous material, such as, but not limited to, graphite powder, graphite fiber, carbon fiber, carbon cloth, vitreous carbon products, activated carbon, nanotubes, fullerenes, and the like.

The filler (e.g., pigment) can be any type of filler conventionally used by those skilled in the art, such as carbonaceous black pigments and organic colored pigments including pigments comprising a blue, black, brown, cyan, green, white, violet, magenta, red, orange, or yellow pigment.

With respect to the polymers that are in the composite and form the matrix, these polymers can be any polymer. For purposes of the present invention, one or more polymers can be present in the polymeric product of the present invention. The polymer can be a rubber, thermoplastic polymer or a thermosetting polymer. Further, the polymer can be a homopolymer, copolymer, terpolymer, and/or a polymer containing any number of different repeating units. Further, the polymer present in the polymeric product of the present invention can be any type of polymer, such as a random polymer, alternating polymer, graft polymer, block polymer, star-like polymer, and/or comb-like polymer. The polymer used in the polymeric product of the present invention can also be one or more polyblends. The polymer can be an interpenetrating polymer network (IPN); simultaneous interpenetrating polymer network (SIN); or interpenetrating elastomeric network (IEN).

Generally, the polymers described in Volume 18 of the Encyclopedia of Chemical Technology, KIRK-OTHMER, (1982), page 328 to page 887, and Modern Plastics Encyclopedia '98, pages B-3 to B-210, both incorporated in their entirety herein by reference, can be used as the polymer in the polymeric product of the present invention.

The polymer used in the polymeric product of the present invention can be prepared in a number of ways and such ways are known to those skilled in the art. The above referenced KIRK-OTHMER section and Modern Plastics Encyclopedia provide methods in which these polymers can be prepared. Polymers from emulsion polymerization, suspension polymerization, bulk polymerization, followed by inversion or mechanical emulsification, phase transfer polymerization can be used.

Knowing the chemical used to alter the surface of the filler, as well as the chemical attachment technique used, can allow one to make a calculated determination of the solubility parameter.

The treated filler can comprise a filler having attached at least one polymeric group. The polymeric group can be any type of polymeric group capable of being attached (e.g., chemically bonded) to the filler, such as, for example, a thermoplastic polymeric group or a thermosetting polymeric group. The polymeric group can be a random polymer, alternating polymer, graft polymer, block polymer, star-like polymer, and/or comb-like polymer. In addition, the polymeric group can be a homopolymer, copolymer, terpolymer, and/or a polymer containing any number of different repeating units. Examples of polymeric groups include, but are not limited to, polycarbonates, polyethers, polyesters, polyacrylates, polymethacrylates, polyurethanes, polystyrenes, polyamines, and polyolefins. Preferably, the polymeric group comprises a phenylether or bisphenyl ether and a substituted propanediyl group. For example, the polymeric group may be a polymer prepared from epoxy bisphenol-A, oligomers of epoxy bisphenol-A, or epoxy novolac. Another preferred polymeric group comprises styrene and maleic anhydride, maleic acid, or salts or derivatives thereof. For example, the polymeric group may be a polymer of styrene and a maleic anhydride half ester. Also, the polymeric group can be attached to the filler at multiple points along the polymer chain through proper choice of substituent groups on the repeating monomer units.

As a specific example, for applications where the polymer matrix is based on copolymers containing acrylate and styrene it has been found that improved wetting can be achieved by designing the surface of the carbon black particle (or other filler) so that it contains any one of the following groups: alkylbenzyl, propylene glycol or polymers of the same, butyl benzoate, or quinodone—styrene maleic anhydride copolymers These groups can be designed on the surface either through chemical bonds or through physiosorption. In the latter case the molecule is designed such that a part of it will absorb onto the surface of the filler (e.g., carbon black) and another part of the molecule will be available for the polymer matrix.

In at least one embodiment of the present invention, the present invention involves creating a library of calculated solubility parameters of treated fillers thereby knowing which treated filler to chose depending upon the solubility parameter of the material forming the continuous matrix, such as the polymer forming the matrix.

Furthermore, as an option, the treated filler can be created by coating the filler using standing coating techniques, such as, but not limited to, plasma, spray coating, or slurry coating.

For instance, surfactant treated fillers can be used, such as polyethylene glycol treated fillers like polyethylene glycol treated carbon black, as described, for instance, in U.S. Pat. Nos. 5,589,531; 5,725,650; 5,747,559; and 5,747,563.

As stated above, preferably the solubility parameter as calculated for the treated filler is within 10% of the solubility parameter of the material used in the matrix, such as the one or more polymers. As an example, preferably the calculated solubility parameter of the treated filler is within ±0.5 √cal/cm. or within ±0.2 √cal/cm.

The present invention is useful in low shear and/or low viscosity applications. When a polymer composite or formulation is created which must be done under low viscosity or low shear conditions due to the sensitivity of the polymer or low viscosity of the medium in which the composite is present, or the low viscosity of the matrix, the present invention can be extremely useful, since by matching the solubility parameters or nearly matching the solubility parameters of the matrix with the filler, one can avoid the need for high shear conditions or the need for high viscosity conditions since by using the present invention, a matrix can wet the filler and a uniform or nearly uniform dispersion of the filler in the matrix under low shear and/or low viscosity conditions can be achieved. The present invention is also useful when the polymer is an emulsion polymer or suspension polymer (meaning, the polymer is formed by emulsion polymerization or suspension polymerization). Typically, emulsion polymers and suspension polymers should not be subjected to high shear conditions since it would destroy or damage the polymer and its usefulness in a polymer matrix.

More specific embodiments of the present invention involve the use of a filler, such as carbon black, and polymers used in toner particles, such as an emulsion. When a toner particle is formed using emulsion aggregation, for instance, the latex and carbon black are introduced in low shear environments. The carbon black and polymer must have an affinity for one another in order for the polymer to wet the surface of the carbon black and thereby form a composite with the well-dispersed particles that is a suitable toner particle.

Using the present invention, the carbon black or other pigment can be treated to form a treated particle, such as a treated carbon black, such that the solubility of the treated particle is similar (e.g., within 10%) of the solubility parameter of the latex, thereby permitting the carbon black and latex to have an affinity for one another to form a uniform or substantially uniform dispersion of the carbon black throughout the polymer used in a toner and thereby form ultimately toner particles having a dispersed carbon black and preferably little or no agglomerations of the carbon black.

In an embodiment of the present invention, the present invention relates to a polymer composite comprising at least one polymer and at least one treated filler dispersed in the composite, wherein the solubility parameter of the polymer and calculated solubility parameter of the filler are similar to each other to achieve a desirable dispersion of the filler in the polymer. The polymer having a solubility parameter and the treated filler having a calculated solubility parameter such that the solubility parameter of the polymer and the solubility parameter of the filler are within ±10% of each other and, more preferably, ±5% of each other, and, more preferably, within ±1% of each other. For example, the solubility parameter of the polymer and the calculated solubility parameter of the filler are preferably within ±0.5 √cal/cm. or within ±0.2 √cal/cm. of each other.

The polymer, the filler, the treated filler, and the solubility parameter of the polymer and calculated solubility parameter of the filler are as described above.

Preferred combinations of the treated filler and polymer are as follows. Each of the fillers are carbon blacks. Any carbon black or other filler can be used. Any polymer can be used.

| Filler | Chemical Used to Treat Filler | Chemical Attached To Filler | Technique Used to Attach Chemical Group | Desirable Polymer in Composite |
|---|---|---|---|---|
| R660R | Aniline | Phenyl | Diazonium reaction | Styrene, poly(styrene-co-butyl acrylate), poly(styrene-co-butadiene) |
| R660R | Polystyrene | Polystyrene | Physiosorption | Styrene, poly(styrene-co-butyl acrylate), poly(styrene-co-butadiene) |
| R660R | Emulsion of polystyrene | Polystyrene | Physiosorption | Styrene, poly(styrene-co-butyl acrylate), poly(styrene-co-butadiene) |
| R660R | Poly(phenylmethylsiloxane) | Poly(phenylmethylsiloxane) | Physiosorption | Styrene, poly(styrene-co-butyl acrylate), poly(styrene-co-butadiene) |
| R660R | Emulsion of Poly(phenylmethylsiloxane) | Poly(phenylmethylsiloxane) | Physiosorption | Styrene, poly(styrene-co-butyl acrylate), poly(styrene-co-butadiene) |

In one or more embodiments of the present invention, the present invention preferably provides a composite wherein no agglomerates or one or less agglomerates of filler are present per 100 sq microns. The agglomeration of filler is understood to mean that two or more fillers are touching each other in the polymer matrix. This can be measured by TEM photos or other techniques, such as SEM or black light optical microscopy.

The present invention also relates to toners using at least one filler or pigment of the present invention, where the polymer and filler can be selected to meet the solubility parameter criteria described above. With respect to suitable toner resins for use in the toner and developer compositions of the present invention, a styrenic polymer can be used, such as a styrenated acrylic resin. Examples of preferred styrenic polymer-based resins include, but are not limited to, homopolymers and copolymers of styrene and its derivatives such as: polystyrene; poly-p-chlorostyrene; polyvinyltoluene; styrene-p-chlorostyrene copolymer; and styrene-vinyltoluene copolymer; copolymers of styrene and acrylic acid esters such as: styrene-methylacrylate copolymer; styrene-ethylacrylate copolymer; and styrene-n-butyl acrylate copolymer; copolymers of styrene and methacrylic acid esters such as: styrene-methyl methacrylate copolymer; styrene-ethyl methacrylate copolymer; styrene-n-butyl methacrylate copolymer; and multi-component copolymers of styrene, acrylic acid ester and methacrylic acid esters; copolymers of styrene and other vinyl monomers such as: styrene-acrylonitrile copolymer, styrene-methyl ether copolymer; styrene-butadiene copolymer; styrene-vinyl methyl ketone copolymer; styrene-acrylonitrile indene copolymer; styrene maleic acid ester copolymer; and the like. These binder resins may be used singly or in combination. Generally, resins particularly suitable for use in xerographic toner manufacturing have a melting point (ring and ball method) in the range of 100° C. to 135° C. and have a glass transition temperature (Tg) greater than about 60° C. Examples of styrenic polymer-based resin particles and suitable amounts can also be found in U.S. Pat. Nos. 5,278,018; 5,510,221; 5,275,900; 5,571,654; 5,484,575; and EP 0 720 066 A1, all incorporated in their entirety by reference herein.

In another or additional embodiment of the present invention, a composite is provided that is a chemical toner for electrophotography that is prepared with treated filler that is dispersed in at least one polymer for improving fixing properties. In the contact fusing process of electrophotography printing, paper with developed image of toner particles is run through a nip between a hot fuser and a pressure roll. The combination of heat and pressure causes toner to spread and adhere to paper, and this process is referred to as toner fixing. The fixing process of electrophotography typically comprises several stages: a) heating to above Tg, b) particle sintering, c) spreading toner melt over paper, d) melt penetration into paper, and e) cooling below Tg. Toner melt rheology plays an important role in stage c and d of the fixing process. Carbon black increases melt viscosity of polymers. Although, 5-7 wt % of carbon black concentration is not expected to substantially change flow melt viscosity during toner spreading, the process of melt penetration into paper is substantially affected by carbon black. According to L-H Lee, in Adhesion Science and Technology, ed. L. H. Lee, Plenum Press, 1976, pp. 831-852, the penetration times of the toner with 5 wt % content of carbon black are several times lower than, pure polymer. The Lee publication attributes the effect to the presence of the yield value in the carbon black-polymer composition of toner. Since pore size of the typical office paper is on the order of several microns, even small carbon black agglomerates prevent toner flow into the paper.

These problems associated with electrophotography printing are resolved at least in part by the present invention, for instance, by providing a chemical toner prepared with treated filler, such as treated carbon black, that is dispersed in at least one polymer, for improving fixing properties. The polymer can be, for example, an emulsion or suspension polymer suitable for formulating toner, such as a latex emulsion or other toner resin emulsion. In one aspect, the chemical toner is prepared with treated filler that can be, for example, treated carbon black or other treated pigment, for instance, as described herein. For instance, the treated filler or treated carbon black can have attached (e.g., chemically, covalently, and the like) one or more chemical groups on the filler. The use of treated filler, like treated carbon black, can eliminate or minimize cohesive carbon black-carbon black particle interaction, improving carbon black-polymer compatibility, which results in better rheological properties of melt toner at lower temperature than would be possible if the conventional filler (e.g., untreated filler) had been used. For example, the chemical toner prepared with the treated carbon black or other treated pigment can have a lower fixing temperature than chemical toner prepared with the conventional carbon black or pigment. The use of treated filler, such as treated carbon black, in chemical toner to improve fixing properties also optionally can be combined with the feature of selecting polymer and filler to meet the solubility parameter criteria as described above.

Generally, the modified fillers or pigment of the present invention, alone or with other pigments, is present in total amounts of from about 1% by weight to about 30% by weight of the toner or developer composition. The amount of pigment present in the toner composition can be from about 0.1 to about 12 wt parts per 100 wt parts of resin. However, lesser or greater amounts of the modified pigment may be used. Also, generally, the toner resin can be present in amounts of from about 60% by weight to about 99% by weight of the toner or developer composition.

Optional external additives may also be mixed or blended with the toner compositions of the present invention including carrier additives; additional positive or negative charge controlling agents such as quaternary ammonium salts, pyridinum salts, sulfates, phosphates, and carboxylates; flow aid additives; silicone oils; waxes such as commercially available polypropylenes and polyethylenes; magnetite; and other known additives. Generally, these additives are present in amounts of from about 0.05% by weight to about 30% by weight, however, lesser or greater amounts of the additives may be selected depending on the particular system and desired properties. Specific examples of additives and amounts are also described in the patents and the European patent application mentioned above and incorporated herein by reference.

The toner compositions can be prepared by a number of known methods, such as admixing and heating the resin, the modified pigment particles, optional charge enhancing additives and other additives in conventional melt extrusion devices and related equipment. Other methods include spray drying and the like. Compounding of the modified pigment and other ingredients with the resin is generally followed by mechanical attrition and classification to provide toner particles having a desired particle size and particle size distribution. Conventional equipment for dry blending of powders may be used for mixing or blending the modified pigment particles with the resin. Again, conventional methods of preparing toner and developer compositions can be used and are described in the patents and European application described above and incorporated herein by reference.

In more detail, the toner material can be prepared by dry blending the binder resin with all other ingredients, including the pigment, and then melt-extruding in a high shear mixer to form a homogeneously mixed mass. During this process the components are held at a temperature above the melting point of the binder resin, and those components that are insoluble in the resin are ground so that their average particle size is reduced. This homogeneously mixed mass is then allowed to cool and solidify, after which it is pre-ground to an average particle size of about 100 microns. This material is then further subjected to particle size reduction until its average particle size meets the size range specification required for classification. A variety of classifying techniques may be used. The preferred type is an air classification type. By this method, particles in the ground material which are too large or too small are segregated from the portion of the material which is of the desired particle size range.

The toner composition of the present invention may be used alone in monocomponent developers or may be mixed with suitable carrier particles to form dual component developers. The carrier vehicles which can be used to form dual component developer compositions can be selected from various materials. Such materials typically include carrier core particles and core particles overcoated with a thin layer of film-forming resin to help establish the correct triboelectric relationship and charge level with the toner employed. Suitable carriers for two component toner compositions include iron powder, glass beads, crystals of inorganic salts, ferrite powder, nickel powder, all of which are typically coated with resin coating such as an epoxy or fluorocarbon resin.

Examples of carrier particles and coatings that can be used and are described in the patents and European application described above and incorporated herein by reference.

The present invention is further directed to a method of imaging which includes formulating an electrostatic latent image on a negatively charged photoconductive imaging member, affecting the development thereof with toner composition comprising resin particles and modified pigment particles, and thereafter transferring the developed image onto a suitable substrate. Conventional methods of imaging can be used, such as shown in the patents and European patent application described above.

The toners, resins, other ingredients, and methods of making the toners and methods of imaging as described in the following patents can be used herein with the one or more fillers (or composites) of the present application: U.S. Pat. Nos. 7,228,092; 7,228,080; 7,226,984; 7,226,714; 7,224,917; 7,224,916; 7,224,914; 7,223,510; 7,223,509; 7,223,508; 7,221,887; 7,221,886; 7,221,881; 7,221,880; 7,220,525; 7,220,524; D542,837; 7,218,880; 7,218,879; 7,217,488; 7,217,487; 7,217,486; 7,217,485; 7,215,910; 7,214,463; 7,214,461; 7,214,460; 7,214,459; 7,214,458; 7,214,412; D541,847; 7,212,764, 7,212,752, 7,211,617; 7,211,362; 7,209,698; 7,209,689; 7,209,688; 7,209,687; 7,208,256; 7,208,255; 7,208,254; 7,208,253; 7,208,252; 7,206,533; 7,206,530; 7,206,526; 7,206,525; 7,205,406; 7,205,357.

The present invention will be further clarified by the following examples, which are intended to be exemplary of the present invention.

EXAMPLES

Example 1

Preparation of Modified Carbon Black 1, wettability testing with mixed styrene-acrylate: Regal™ 660 carbon black (commercially available from Cabot Corporation) having attached phenyl groups was prepared by the diazonium treatment of carbon black with aniline. A 1000 g sample of Regal 660 carbon black was charged in ProcessAll 4L mixer with 447.7 g of 16% methane sulfonic acid. After 5 min mixing, 63.0 g of aniline was added to the reactor. A solution of 46.8 g of sodium nitrite in 234 g of water was slowly added to the reactor when the temperature reached 65° C. The reaction was run for 30 min after the end of the sodium nitrite addition.

Figure 2:
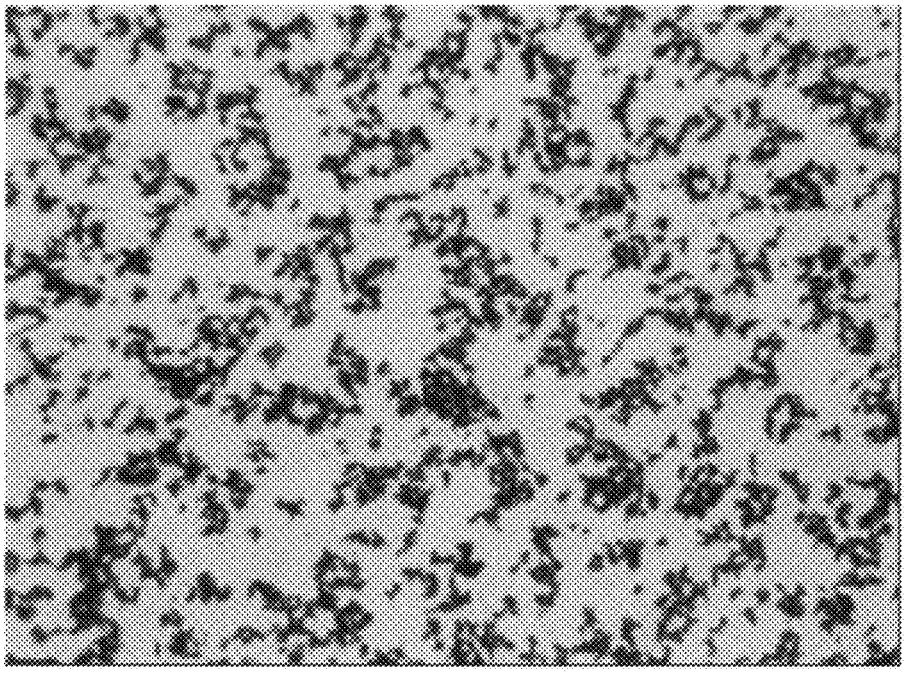

A 1.1 g sample of modified Regal 660 (Modified Carbon Black 1) was mixed with 44.3 g of poly(styrene-co-butyl acrylate) toner polymer B1548 (manufactured by Image Polymers). The mixture was added to a Brabender Sigma blade mixer, which was preheated to 160° C. The composite was mixed for 30 min at 60 RPM. Film from the polymer dispersion was pressed in a Carver press preheated to 175° C. at 2500 psi for 5 minutes between Mylar sheets. Small pieces (~1 mg) of film were arranged between microscope slides kept together with binder clips and placed in 200° C. oven overnight. An optical microscopy picture of the dispersion containing phenyl-modified Regal 660 is shown in FIG. 1 and non-modified R660 is shown on FIG. 2. One can see that phenyl modified Regal 660 provided better dispersion with the toner polymer.

Example 2

Preparation of Modified Carbon Black 2, its dispersion in EtOAc, let down with polyester polymer, coating films: Regal™ 330 carbon black (commercially available from Cabot Corporation) having attached 4-fluorophenyl groups was prepared by diazonium treatment of a carbon black sample with 4-fluoroaniline. A 1200 g sample of Regal 330 carbon black was charged in ProcessAll 4L mixer with 480.8 g of 8.9% nitric acid. After 5 min mixing 75.2 g of 4-fluoroaniline was added to the reactor. A solution of 46.7 g of sodium nitrite in 186.8 g of water was slowly added to the reactor when its temperature reached 65° C. The reaction was run for 30 min after the end of the sodium nitrite addition. Treated carbon black from the reactor was washed with 5 volumes of water and dried at 85° C. for 12 hours.

Figure 3:
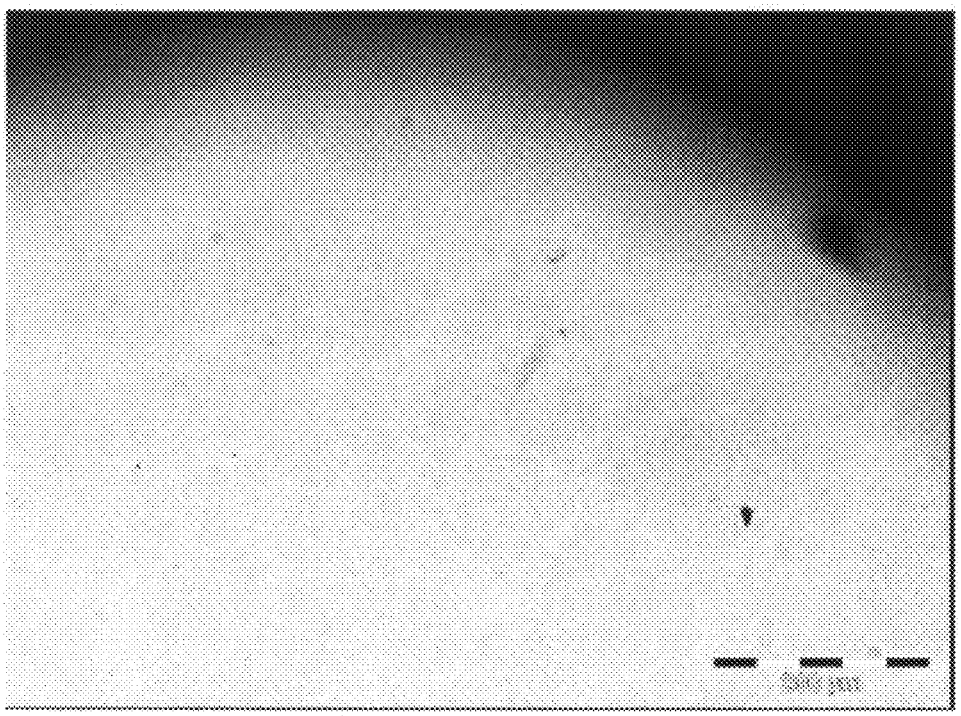

A 20 g dried sample from the reaction above was mixed with 80 g of ethyl acetate and, after addition of glass beads (2 mm diameter, 100 g), was shaken in a metal can in a Scandex paint shaker for 4 hours. The average particle size of the dispersion, determined by light scattering (UPA) was 370 nm. The dispersion of modified R330 in ethyl acetate was let down with an ethyl acetate solution of polyester toner polymer FINE-TONE T-6694 (commercially available from Reichhold). The let down formulation was coated on a glass slide and dried at 60° C. The resulting polyester film contained 0.5% of modified Regal 330 carbon black. Optical image of this film (FIG. 3) shows no carbon black agglomerates and excellent compatibility of black pigment with the polyester resin.

Example 3

Preparation of Modified Carbon Black 3 (R660 pelletized with styrene acrylic): Regal 660 carbon black having adsorbed styrene acrylic polymer was prepared by spraying styrene acrylic aqueous emulsion Lucidene 361 (commercially available from Rohm & Haas). A 50 g sample of Lucidene 361 was diluted with 204 g of DI water and slowly sprayed in a batch pelletizer over 500 g sample of Regal 660 carbon black. Mixing in a pelletizer continued for 30 min after end of emulsion addition. Carbon black was dried at 85° C. for 12 hours.

Figure 4:
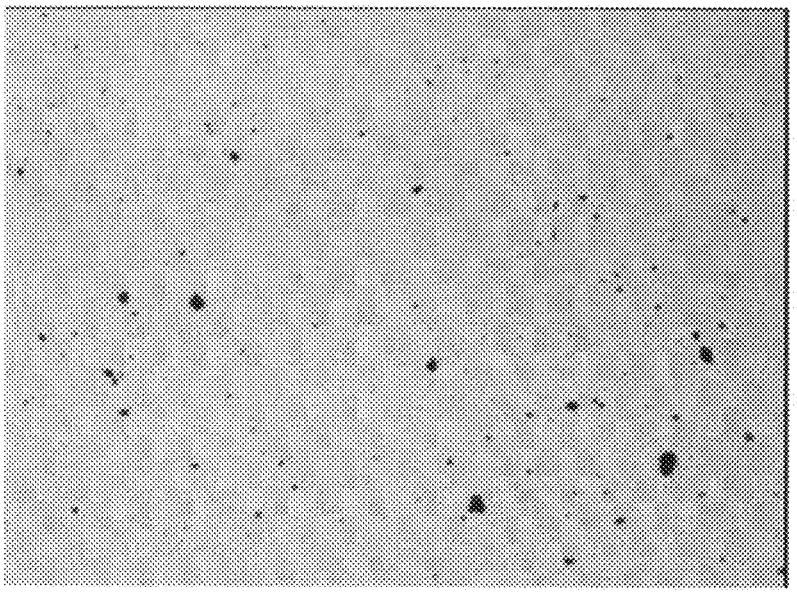
Figure 5:
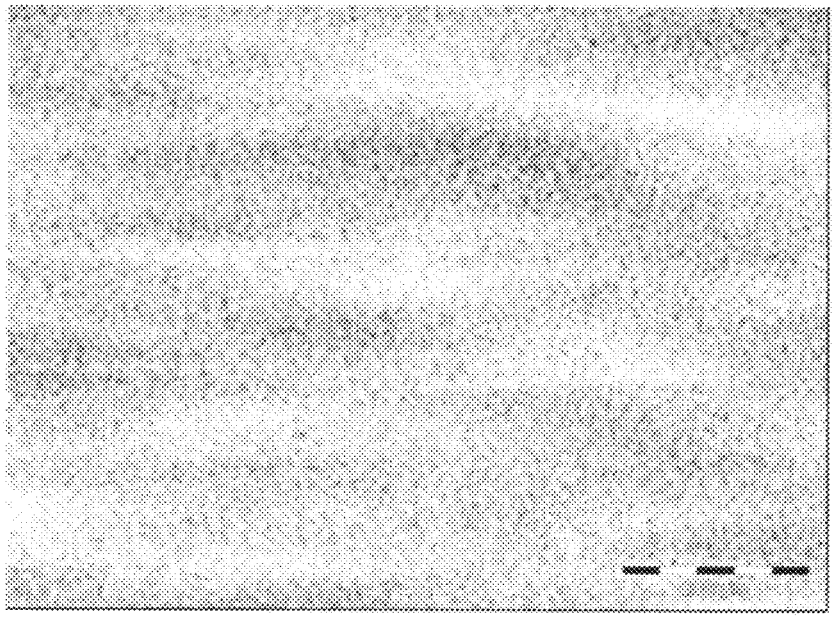

A 1.1 g sample of modified Regal 660 was mixed with 44.3 g of poly(styrene-co-butyl acrylate) toner polymer B1548 (manufactured by Image Polymers). The mixture was added to a Brabender Sigma blade mixer, which was preheated to 160° C. The composite was mixed for 30 min at 60 RPM. Film from the polymer dispersion was pressed in a Carver press preheated to 175° C. at 2500 psi for 5 minutes between Mylar sheets. Small pieces (~1 mg) of film were arranged between microscope slides kept together with binder clips and placed in a 200° C. oven overnight. An optical microscopy picture of the dispersion containing the polymer modified Regal 660 is shown in FIG. 4. One can see that the quality of the dispersion is significantly better than for non-modified R660 shown on FIG. 2.

Example 4

Preparation of Modified Carbon Black 3 (R330 with Joncryl 611) dispersion in EtOAc, let down with toner polymer Films: Regal 330 carbon black having adsorbed styrene acrylic resin was prepared by dispersing carbon black in ethyl acetate with Joncryl 611 resin (commercially available from Johnson polymers). A 20 g sample of R330 was mixed with log of Joncryl 611 resin and 70 g of Ethyl Acetate in a metal can. Glass beads (2 mm diameter, 100 g) were added and the can was put in a Skandex paint shaker for 4 hours. Average particle size of the resulting dispersion measured by light scattering (UPA) was 223 nm. Dispersion of R330 (mill base) was let down with an ethyl acetate solution of polyester toner polymer FINE-TONE T-6694 (commercially available from Reichhold). The let down formulation was coated on a glass slide and dried at 60° C. The resulting polyester film contained 1% of Regal 330 carbon black. An optical microscopy image of this film (FIG. 4) showed no carbon black agglomerates and excellent compatibility of the black pigment with the polyester resin.

Example 5

3.0 g Regal 660 was mixed by hand with 60 g of poly (styrene-co-butyl acrylate). The mixture was added to a Brabender Sigma blade mixer which was preheated to 160° C. The composite was mixed for 3 min. Mixing was stopped and the Brabender was allowed to cool down to room temperature. The composite was removed. Three samples were selected from the bulk material. These three samples were cross-sectioned using a diamond microtome, mounted on grids and analyzed by TEM. The composite consists of a polymer matrix and a filler. The filler is a carbon black, namely Regal 660 modified with butyl benzoate. The polymer matrix is poly(styrene-co-butyl acrylate). It is evident that several agglomerates can be observed in the image frame.

Example 6

3.0 g Mogul L was mixed by hand with 60 g of poly (styrene-co-butyl acrylate). The mixture was added to a Brabender Sigma blade mixer which was preheated to 160° C. The composite was mixed for 3 min. Mixing was stopped and the Brabender was allowed to cool down to room temperature. The composite was removed. Three samples were selected from the bulk material. These three samples were cross-sectioned using a diamond microtome, mounted on grids and analyzed by TEM. 13 agglomerates greater than 2 microns are visible.

Applicants specifically incorporate the entire contents of all cited references in this disclosure. Further, when an amount, concentration, or other value or parameter is given as either a range, preferred range, or a list of upper preferable values and lower preferable values, this is to be understood as specifically disclosing all ranges formed from any pair of any upper range limit or preferred value and any lower range limit or preferred value, regardless of whether ranges are separately disclosed. Where a range of numerical values is recited herein, unless otherwise stated, the range is intended to include the endpoints thereof, and all integers and fractions within the range. It is not intended that the scope of the invention be limited to the specific values recited when defining a range.

Other embodiments of the present invention will be apparent to those skilled in the art from consideration of the present specification and practice of the present invention disclosed herein. It is intended that the present specification and examples be considered as exemplary only with a true scope and spirit of the invention being indicated by the following claims and equivalents thereof.

What is claimed is:

1. A toner composition comprising a resin and a colorant, wherein the colorant is a) a pigment having attached at least one organic group selected from the group consisting: —Ar, —Ar-Alk$_x$,

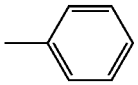

-continued

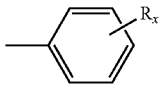

where R is Alk, and x is from 1 to 5

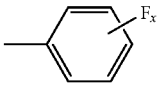

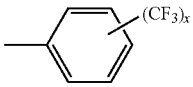

and

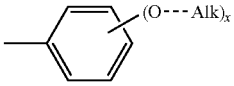

wherein the organic group is directly attached to the pigment, and where Ar is aryl or arylene group, Alk is an alkyl or alkylene group having 1 to 5 carbons and substituted with at least one fluoro group, x is an integer of 1 to 5, and where x is 2 or more, each of the substituents are the same or different, and wherein Ar is substituted with one or more of H and OR', wherein R' is independently branched or unbranched $C_1$-$C_{20}$saturated or unsaturated alkyl, alkenyl, alkynyl, aryl, heteroaryl, alkaryl, or aralkyl, b) a modified colorant comprising a colorant with at least one adsorbed phenyl containing polymer on the colorant's surface, or c) a modified pigment comprising the reaction product of a pigment and a diazonium salt of 4-fluoroaniline.

2. The toner composition of claim 1, wherein the colorant is a pigment having attached at least one organic group selected from the group consisting of: —Ar, —Ar-Alk$_x$,

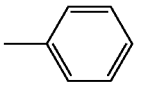

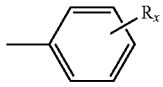

where R is Alk, and x is from 1 to 5

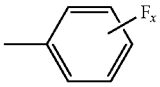

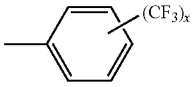

and

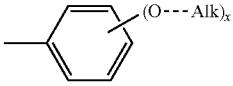

wherein the organic group is directly attached to the pigment, and where Ar is aryl or arylene group, Alk is an alkyl or alkylene group having 1 to 5 carbons and substituted with at least one fluoro group, x is an integer of 1 to 5, and where x is 2 or more, each of the substituents are the same or different, and wherein Ar is substituted with one or more of H and OR', wherein R' is independently branched or unbranched $C_1$-$C_{20}$ saturated or unsaturated alkyl, alkenyl, alkynyl, aryl, heteroaryl, alkaryl, or aralkyl.

3. The toner composition of claim 2, wherein the toner composition has an aspect-ratio of about 1.0 to about 3.0.

4. The toner composition of claim 2, wherein the toner composition has a mean particle size of from about 3 to about 10 microns.

5. The toner composition of claim 1, wherein the colorant is a modified colorant comprising a colorant with at least one adsorbed phenyl containing polymer on the colorant's surface.

6. The toner composition of claim 5, wherein said adsorbed phenyl containing polymer is a polystyrene, a poly(styrene-acrylate), a polyester, or a poly(phenylmethylsiloxane).

7. The toner composition of claim 5, wherein the toner composition has a mean particle size of from about 3 to about 10 microns.

8. The toner composition of claim 1, wherein said toner composition is a chemical toner.

9. The toner composition of claim 1, wherein the colorant comprises a blue pigment, a black pigment, a brown pigment, a cyan pigment, a green pigment, a white pigment, a violet pigment, a magenta pigment, a red pigment, a yellow pigment, an orange pigment, or mixtures thereof.

10. The toner composition of claim 1, wherein the pigment is a carbon product.

11. The toner composition of claim 10, wherein the carbon product is a carbon product comprising a carbon phase and a metal-containing species phase.

12. The toner composition of claim 10, wherein the carbon product is an aggregate containing a carbon phase and a silicon-containing species phase.

13. The toner composition of claim 1, wherein the pigment is carbon black.

14. A chemical toner composition comprising a resin and a colorant, wherein the colorant is a) a pigment having attached at least one organic group selected from the group consisting of: —Ar, —Ar-Alk$_x$,

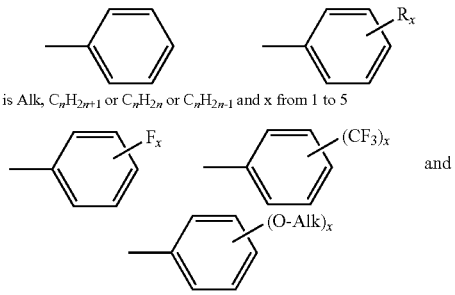

where R is Alk, $C_nH_{2n+1}$ or $C_nH_{2n}$ or $C_nH_{2n-1}$ and x from 1 to 5 and wherein the organic group is directly attached to the pigment, and where Ar is aryl or arylene group, Alk is an alkyl or alkylene group or an alkyl or alkylene group having 1 to 5 carbons and substituted with at least one fluoro group, x is an integer of 1 to 5, n is an integer of 1 to 5, and where x is 2 or more, each of the substituents are the same or different, and wherein Ar and Alk are independently substituted with one or more of H, R', and OR', wherein R' is independently branched or unbranched $C_1$-$C_{20}$, saturated or unsaturated alkyl, alkenyl, alkynyl, aryl, heteroaryl, alkaryl or aralkyl, b) a modified colorant comprising a colorant with at least one adsorbed phenyl containing polymer on the colorant's surface, or c) a modified pigment comprising the reaction product of a pigment and a diazonium salt of 4-fluoroaniline.

* * * * *